US005531528A

United States Patent [19]

Duerr et al.

[11] Patent Number: 5,531,528

[45] Date of Patent: Jul. 2, 1996

[54] CARTRIDGE FOR PRINTERS

[75] Inventors: Karl W. Duerr, Watchung; John J. Krivda, Ewing, both of N.J.

[73] Assignee: Duerr Tool & Die Co., Inc., Kenilworth, N.J.

[21] Appl. No.: 310,884

[22] Filed: Sep. 22, 1994

[51] Int. Cl.[6] ..... B41J 31/16

[52] U.S. Cl. ..... 400/200; 400/196

[58] Field of Search ..... 400/194, 195, 400/196, 196.1, 197, 200, 202

[56] References Cited

U.S. PATENT DOCUMENTS

| | | | |
|---|---|---|---|
| 4,091,914 | 5/1978 | Stipanuk . | |
| 4,269,520 | 5/1981 | Gabler | 400/196 |
| 4,472,074 | 9/1984 | Gabler | 400/196 |
| 4,536,098 | 8/1985 | Sheehan et al. | 400/196.1 |
| 4,623,274 | 11/1986 | Ohsaki . | |
| 4,741,639 | 5/1988 | Fausto et al. . | |
| 4,940,345 | 7/1990 | Raar . | |
| 5,145,268 | 9/1992 | Cavallini . | |
| 5,215,012 | 6/1993 | Kanno et al. . | |

*Primary Examiner*—Christopher A. Bennett
*Attorney, Agent, or Firm*—Horst M. Kasper

[57] ABSTRACT

A replaceable ribbon cartridge for printers is disclosed and which has a user controllable re-inking capability. The cartridge includes both a movable ink transfer roller and a fixedly disposed drive roller, both of which contact the advancing ribbon during printing operations. Also, a re-inking roller is provided, and the re-inking roller is laterally movable so as to permit the user to selectively move the re-inking roller from a neutral, first position, wherein it has no contact with the ink transfer roller, to a second operative position wherein the re-inking roller is in contact with the ink transfer roller. The re-inking roller is in contact with the drive roller both in the first operative position as well as in the second operative position.

18 Claims, 5 Drawing Sheets

CARTRIDGE FOR PRINTERS

BACKGROUND OF THE INVENTION

1. Field of the Invention

The present invention relates to a replaceable cartridge for printers and having a user controllable re-inking capability.

2. Brief Description of the Background of the Invention Including Prior Art

The art knows replaceable ribbon cartridges adapted for use with computer printers, typewriters, and other types of printers.

Kanno et al. teach in U.S. Pat. No. 5,215,012 a replaceable ribbon cartridge for printers, where the cartridge has a user controllable re-inking capability. Both an ink transfer roller and a drive roller for contacting the advancing ribbon during printing operations are included in the cartridge. The reference teaches a re-inking roller, where the re-inking roller is laterally movable allowing the user to selectively move the re-inking roller to a neutral position wherein it has no substantial contact with either the ink transfer roller or the drive roller, to a first operative position wherein the re-inking roller is in substantial contact only with the ink transfer roller, or to a second operative position wherein the re-inking roller is in contact with both the ink transfer roller and the drive roller.

Cavallini in U.S. Pat. No. 5,145,268 teaches a cassette containing an inked ribbon. According to Cavallini, at least one pulling roller is partly supported, in a rotatable manner, in at least one slot provided in a wall of a cassette, and is at least partly supported in a rotatable manner in a carriage which is mobile relative to a wall of the cassette. The pulling roller is engaged with elastic means to urge said pulling roller against abutment means on said slot.

Raar in U.S. Pat. No. 4,940,345 teaches an ink cassette and ink transfer roll therefor. The reference provides that during rotary movement an ink transfer takes place from an ink roll to an intermediate roll.

Fausto et al. in U.S. Pat. No. 4,741,639 teach a cartridge for an inked ribbon with a re-inking pad. The re-inking pad of the reference is rotatable with its shaft within a casing, while a distribution roller is also rotatable within the casing, but additionally can slide in slots in a plane which is substantially co-planar with said shaft. The inked ribbon engages the distribution roller and, based on the tension imparted to the inked ribbon by other rollers, the inked ribbon causes the distribution roller to slide along said slots and causes the distribution roller to be held in contact with the re-inking pad.

Ohsaki in U.S. Pat. No. 4,623,274 teaches an ink ribbon cartridge. A spring mechanism is taught which urges a pressure roller to move toward a feed roller.

Stipanuk in U.S. Pat. No. 4,091,914 teaches a wear-activated ribbon re-inker. A transfer roller is disposed adjacent to a porous ink roll. The transfer roller rotates on an axle as the ribbon advances by the pull of drive rollers. The axle is furnished with eccentric mounting pins. The axle is kept from rotating by tight frictional engagement of the pins with walls, but the axle may be turned with a screwdriver or other tool for purposes of adjustment. The eccentric nature of the mounting pins causes the main portion of the axle and thus the transfer roller to move closer or further from the porous ink roll. This allows to adjust the spacing between the porous ink roll and the transfer roller.

The use of porous ink rollers is further taught in U.S. Pat. No. 4,653,947, U.S. Pat. No. 4,913,571, U.S. Pat. No. 4,741,639, and in Japanese Utility Model Publication No. 4-7155. In general, a porous, ink filled roller is rotatably mounted in a casing, with the ink filled roller being in contact with a transfer roll, where the transfer roll in turn engages the ribbon. The above recited Japanese Utility Model No. 4-7155 and U.S. Pat. No. 5,215,012 teach that the ink filled roller may be moved laterally by the user to vary the contact pressure between the ink filled roller and the transfer roller, thereby varying the rate of ink transfer.

SUMMARY OF THE INVENTION

1. Purposes of the Invention

The object of the present invention is to provide an ink ribbon cassette which provides for controlled inking and/or re-inking of the ribbon such that, independent of the control position, at least some inking will occur.

It is another object of the present invention to provide an ink ribbon cassette where the supply of ink to the ribbon to be inked can be more or less proportionally controlled.

It is a further object of the present invention to provide an ink ribbon cassette which allows to define a level of squeezing of an ink supply roller.

It is yet another object of the present invention to simplify the adjustment level of re-inking a print ribbon cassette.

It is a further object of the present invention to furnish an ink ribbon cassette, where the degree of re-inking is continuously adjustable by the user.

These and other objects and advantages of the present invention will become evident from the description which follows.

2. Brief Description of the Invention

The present invention provides for a replaceable ribbon cartridge for printers and which has a user-controllable re-inking capability. An endless ribbon is positioned within a casing so as to be disposed along a path which includes a portion outside of said casing at a printing location. A drive means advances said ribbon along said path and comprises a drive roller rotatably mounted in said casing adjacent said path and so as to be in contact with said ribbon. An ink transfer roller is rotatably disposed in said casing adjacent said path so as to be in contact with said ribbon. A porous re-inking roller is rotatably disposed in said casing. Means are provided for rotatably positioning said ink transfer roller in said casing and include means controllable by the user for laterally moving said ink transfer roller between a first operative position, where there is no engagement between the ink transfer roller and the re-inking roller, and a second operative position, where there is an engagement between the ink transfer roller and the re-inking roller.

The drive roller can be disposed for continuously engaging the re-inking roller and for transferring and imposing a rotation of the drive roller to the re-inking roller.

Means can be provided for rotatably mounting said ink transfer roller so as to be movable by a predetermined distance toward and away from said re-inking roller. Preferably, said path of said ribbon is positioned so that the ribbon contacts the ink transfer roller on the side thereof opposite said re-inking roller. The ink transfer roller can include a central borehole. The means for rotatably mounting said ink transfer roller can include an actuator, a link arm, and a pin attached perpendicular to the link arm. The link arm can be eccentrically engaged by the actuator. The pin can be inserted into the central borehole of the ink transfer roller.

The ink transfer roller can include a central borehole. The means for rotatably mounting said ink transfer roller can include a rotatable actuator having a cylindrical cam having a central cam axis laterally spaced relative to a position of a rotation axis of the rotatable actuator, as well as a flat link arm having a circular hole for bearing the cylindrical cam for the rotatable actuator to eccentrically engage the flat link arm, and a pin attached perpendicular to a flat side of the link arm. The pin is insertable into the central borehole of the ink transfer roller. Preferably, means are provided for defining an angular position of the flat link arm relative to the central cam axis of the cylindrical cam. The flat link arm can be provided with an elongated slot. A cover of the casing can be provided with a guide projection engaging the elongated slot for substantially maintaining an angular position of the link arm relative to the central cam axis of the cylindrical cam.

Said drive means can further comprise an idler roller rotatably mounted to said casing at a location on a side of said drive roller opposite to said re-inking roller, where said path of said ribbon passes between said drive roller and said idler roller.

Said ink transfer roller and said drive roller can each include axially directed spline means on the outer periphery thereof for facilitating a transfer of ink from said re-inking roller to said ribbon.

A means for rotatably mounting said re-inking roller can comprise a bushing having an opening and a mounting post, where the mounting post is fixedly mounted to said casing, as well as a central opening extending through said re-inking roller coaxially with respect to the peripheral surface thereof. Said mounting post is being received in the opening of the bushing inserted in said central opening of the re-inking roller. Said opening of the bushing can have a diameter similar to that of said mounting post so as to permit rotation of the re-inking roller around the mounting post. Said means controllable by the user for laterally moving said ink transfer roller can comprise a link arm defining the operative position of the ink transfer roller and having a circular hole disposed on a first end and a longitudinal slot disposed on a second end. A guide projection can be disposed at the cover and engage the longitudinal slot disposed on the second end of the link arm. An actuator can have a rotation axis and include a cylindrical cam sized so as to be closely received in said circular hole of said link arm. Said circular hole can define an axis of the cylindrical cam, where the axis of the cylindrical cam can be laterally offset from said rotation axis of the actuator. Said circular hole can receive said cylindrical cam therein such that a rotation of said actuator causes said ink transfer roller to laterally move relative to said rotation axis of the actuator. Said actuator can further comprise an integral tab adapted to be engaged by fingers of the user for rotating the actuator about the rotation axis of the actuator, and so as to move said ink transfer roller between said first and second operative positions. Said actuator can further comprise a radial flange, wherein said casing includes a cover closely overlying said flange. Said cover can have an actuator opening therethrough. Said integral tab can extend through said actuator opening so as to be readily gripped by the fingers of the user.

Said flange of said actuator can include a radial finger at the periphery thereof. Two limit stops can be disposed at said cover. The limit stops can be adapted to limit the rotational movement of said actuator between predetermined limits defined by the location of said limit stops or, respectively, by the location of said radial finger on the actuator. Two indentations can be disposed in each case neighboring the limits stops at said cover. Each indentation can be adapted to be engaged by a button disposed on the radial finger depending on the operative position of the actuator.

Said means for moving said ink transfer roller can have a provision for moving the same to a first operative position, where said ink transfer roller has no contact with said re-inking roller.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 2:
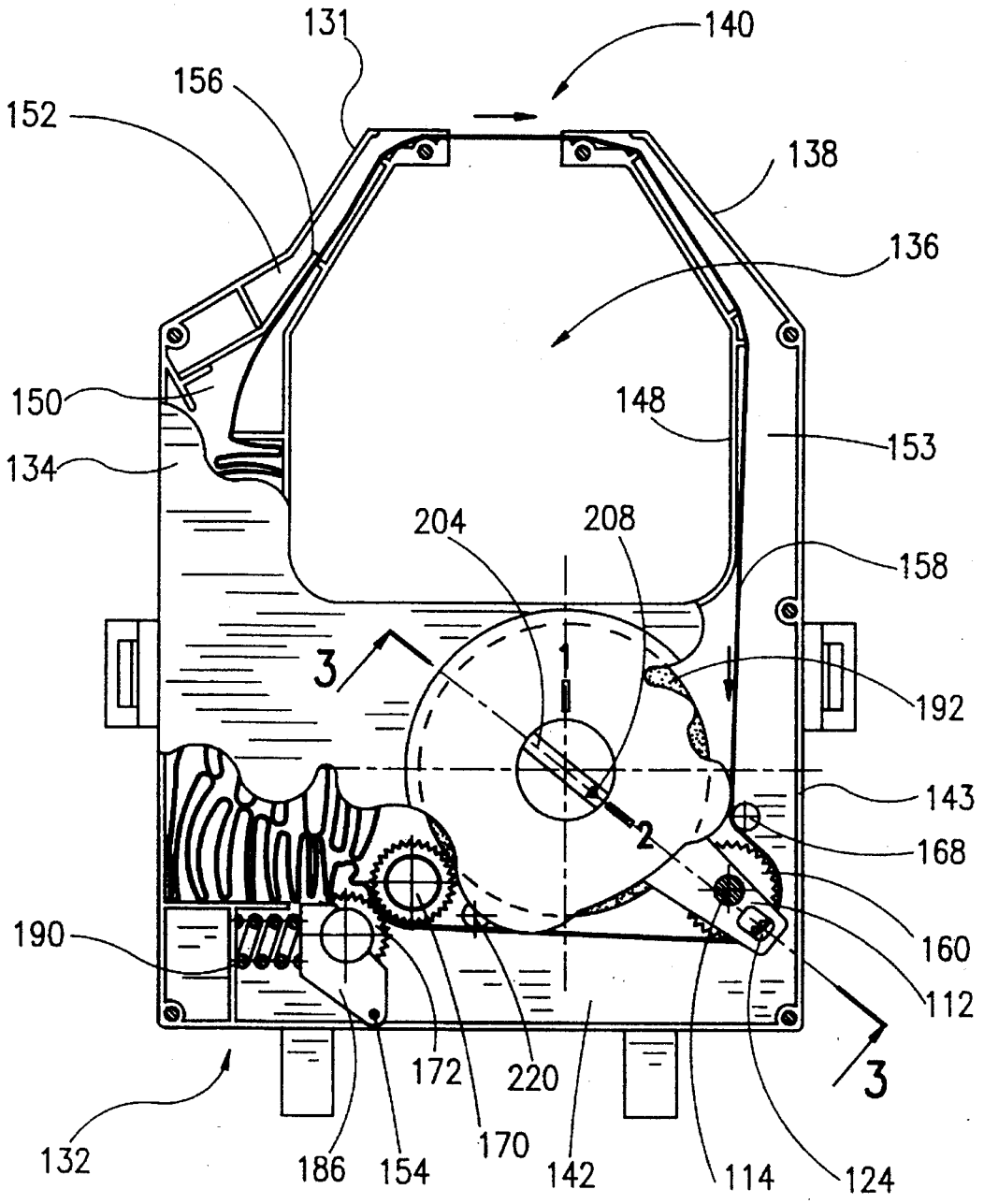
FIG. 2 is a plan view of the cartridge shown in FIG. 1, where the cover is partly broken away.

In accordance with the present invention there is provided a replaceable ribbon cartridge which embodies the present invention and which is indicated generally at 130. A base member 132 and a cover 134 form a casing of the cartridge 130. The casing is formed of molded plastic or of another suitable material. FIG. 2 shows that the casing has a configuration resembling a C-shape and defining a central casing opening 136. The central casing opening 136 is surrounded by a supply guide arm 131, for delivering the inked ribbon to the print position and positioned at a first side as seen in FIG. 2, and by a return guide arm 138, for receiving the ribbon after printing has taken place and positioned at a second side opposite to said first side. A printing location 140 is located between the outer extremities of the two laterally spaced apart guide arms 131, 138.

A bottom wall 142, an outer peripheral side wall 143 which is joined to the bottom wall 142, and an interior side wall 148 form the base member 132 of the casing. The interior side wall 148 is joined to the bottom wall 142 along the periphery of the central casing opening 136 and thereby forms an internal enclosure between the bottom wall 142 and the cover 134.

A ribbon storage chamber 150, a ribbon supply passage 152 extending from the ribbon storage chamber 150 through the supply guide arm 131, and a ribbon return passage 153 extending through the return guide arm 138, are included in the internal enclosure. An endless inked fabric ribbon 158 is positioned within the casing. The bulk of the ribbon 158 is formed into multiple folds and positioned in the ribbon storage chamber 150.

An ink transfer roller 160, having a splined peripheral surface and having a relatively large central borehole 162 (FIG. 3), is disposed inside the internal enclosure of the casing. A post 78 supports and guides the ink transfer roller 160 and the relatively large central borehole 162 of the ink transfer roller 160 surrounds the post 78. The post 78 is fixed to the bottom wall 142 of the casing. The length of the post 78 is such as not to interfere with a pin 114 further described below. Preferably, the length of the post 78 is less than half the depth of the relatively large central borehole 162. The outer diameter of the post 78 is a fraction of the inner diameter of the relatively large central borehole 162. A means for rotatably mounting said ink transfer roller 160 includes a rotatable actuator 196 having a cylindrical cam 116 having an axis 68 laterally spaced relative to a position of a rotation axis of the rotatable actuator 196, a flat link arm 112 having a circular hole 118 (FIG. 4) for bearing the cylindrical cam 116 for the actuator 196 to eccentrically engage the flat link arm 112, and a pin 114 attached perpendicular to a flat side of the link arm 112. The pin 114 is inserted into the central borehole 162 of the ink transfer roller 160. The ink transfer roller 160 is supported and slides on the bottom wall 142 so as to permit the ink transfer roller 160 to move laterally and/or to rotate. The ink transfer roller 160 is further rotatably supported on and guided by the pin 114 which extends through the central borehole 162 of the ink transfer roller 160. The pin 114 is fixed to a bottom side of the link arm 112 and extends with its axis in a direction perpendicular to the flat side of the link arm 112. The position of the ink transfer roller 160 in an axial direction is defined by the upper side of the bottom wall 142 and by the lower side of the link arm 112. The outer diameter of the pin 114 is slightly less than the diameter of the central borehole 162 so as to permit the ink transfer roller 160 to rotate about its axis around the pin 114. The link arm 112 is constructed to be laterally movable by a defined distance and the ink transfer roller 160 moves with the link arm 112 and the pin 114 laterally over a predetermined distance. The outer diameter of the post 78 is smaller than the inner diameter of the relatively large central borehole 162 minus the maximum length of the lateral motion of the link arm 112. The post 78 is positioned such that the ink transfer roller 160 can be moved by the pin 114 laterally without being impeded by the post 78.

Figure 3:
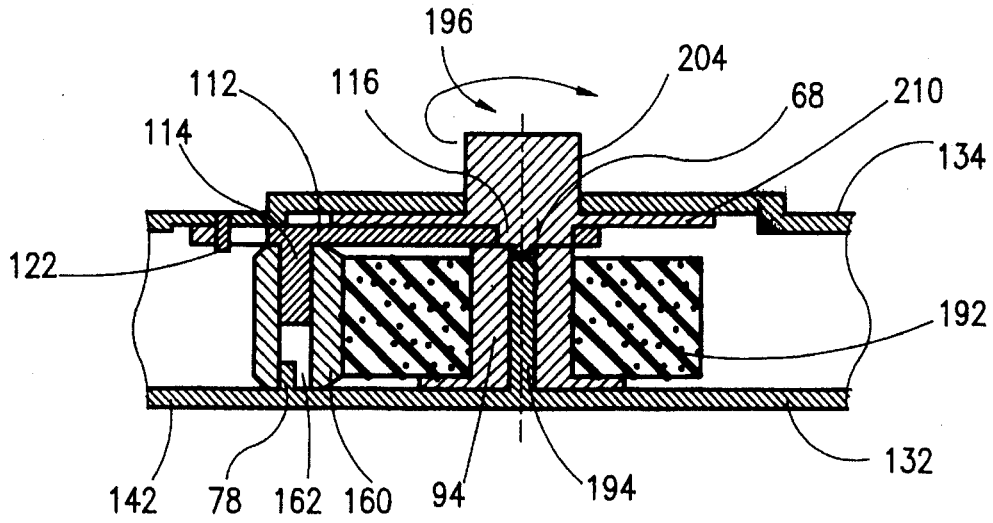
FIG. 3 is a sectional view of the cartridge as viewed along section line 3—3 of FIG. 2.
Figure 4:
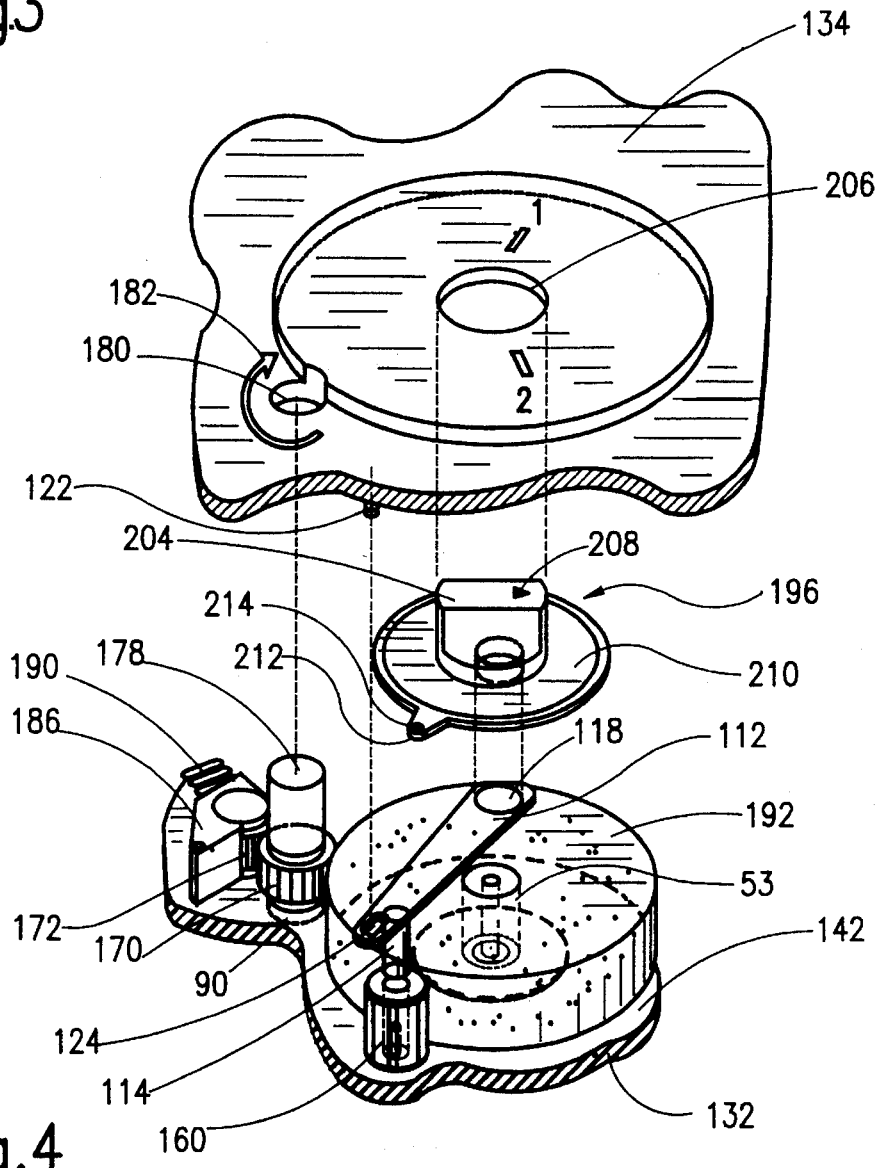
FIG. 4 is an exploded perspective view of the re-inking components of the cartridge.

The cover 134 is furnished with a guide projection 122. The guide projection 122 engages a longitudinal slot 124 disposed on the link arm 112 on the side which, with respect to the pin 114, is relatively remote from the re-inking roller 192, as illustrated in FIG. 4. The longitudinal slot 124 extends in a radial direction relative to the axis 68 of the cylindrical cam 116 (FIG. 3). The longitudinal slot 124, engaging the guide projection 122, restricts the motion of the link arm 112 to substantially a radial motion, not considering alignment and the tangential motion component caused by the rotation of the axis 68 of the cylindrical cam 116 around the rotation axis of the actuator 196.

A first ribbon guide post 168 is mounted immediately adjacent to the side of the ink transfer roller 160, where the ribbon to be inked arrives at the ink transfer roller 160 as seen in FIG. 2.

A ribbon drive means is provided for advancing the ribbon 158 along its path of travel. The ribbon drive means includes a drive roller 170 and an idler roller 172.

As shown in FIG. 4, the drive roller 170 includes a splined cylindrical peripheral surface and the drive roller 170 is rotatably mounted to the bottom wall 142. The lower end of the drive roller 170 includes an axial drive bore 174 (FIG. 6), which axial drive bore 174 is aligned with and communicates with a drive shaft opening 90 (FIG. 4) in the bottom wall 142, and which axial drive bore 174 is adapted to receive the drive shaft of the printer in a conventional manner. The upper end of the drive roller 170 includes a finger tab 178, which extends through a drive roller opening 180 in the cover 134, and so that the ribbon may be advanced by hand by rotating the finger tab 178 in the direction of the arrow 182 which is placed on the cover. The finger tab 178 can be provided by a splined cylindrical part having a length of from about 0.8 to 1.2 times the height of the outer peripheral side wall 143 and representing an extension of the splined drive roller 170.

As shown in FIG. 2, a second ribbon guide post 220 is fixed to the bottom wall 142 near the outer peripheral side wall 143 for guiding the incoming ribbon 158 to the nip between the drive roller 170 and the idler roller 172. The idler roller 172 is rotatably mounted on a lever arm 186 which in turn is pivotally mounted to a post 154 disposed close to the outer peripheral side wall 143. The idler roller 172 includes a splined peripheral surface. The idler roller 172 is biased toward the drive roller 170 by means of a spring 190, so as to tightly engage the ribbon 158 which passes between the drive roller 170 and the idler roller 172. The ribbon 158 is advanced through the nip formed between the drive roller 170 and the idler roller 172 upon rotation of the drive roller 170 in the direction of the arrow 182 (FIG. 4), wherein the idler roller 172 also rotates in case of a rotation of the drive roller 170.

A re-inking roller 192, formed of a porous foam material which is initially impregnated with ink, is rotatably mounted in the casing. When the axis of the drive roller 170 and the axis of the ink transfer roller 160 are connected to the axis of the re-inking roller 192, then an angle of from about 90 to 120 degrees is formed between the connecting lines. Thus, the ink transfer roller 160 and the drive roller 170 are disposed on one side of the re-inking roller 192. The re-inking roller 192 includes a central opening 53 of relatively large diameter extending through the re-inking roller 192 coaxially with its outer periphery. The re-inking roller 192 is mounted by means of a bushing 94 and a mounting post 194 (FIGS. 3 and 4), where the mounting post 194 is fixed to the bottom wall 142 of the casing. The mounting post 194 is received in the opening of the bushing 94. The central opening 53 of the re-inking roller 192 has a diameter which is smaller than the outer diameter of the bushing 94 to such an extent that the porous-foam re-inking roller 192 closely fits around the outer circumference of the bushing 94. The diameter of the opening of the bushing 94 is slightly larger than the outer diameter of the mounting post 194 so as to permit the re-inking roller 192 together with the bushing 94 to rotate about their axes around the mounting post 194. A relatively close fit between the central opening 53 of the re-inking roller 192, the bushing 94, and the mounting post 194 will lead to rotate steadily and more uniformly the re-inking roller 192 and thus to apply the ink more uniformly to the ink transfer roller 160 and to the drive roller 170 as compared to a process where e.g. the re-inking roller 192 would roll along the periphery of the mounting post 194.

The link arm 112 is adapted to be moved to a continuous sequence of lateral positions, predetermined by the user, by means of the actuator 196 which is best seen in FIGS. 3 and 4. As the actuator 196 is separated from the rotating re-inking roller 192 by the stationary mounting post 194, there will be no tendency that a rotation of the re-inking roller 192 will also entail somehow a change in position of the actuator 196 as would be possible in a construction where the mounting post is rotatable. Thus, it is possible to provide a continuous sequence of positions to be assumed by the actuator 196 without a need to provide for any engagement means at certain positions, since there is no danger that the rotation of the re-inking roller 192 could somehow induce a change in position of the actuator 196. Thus, the link arm 112 separates a rotation of the re-inking roller 192 from a possible change in position of the actuator 196, for example, by a frictional engagement between re-inking roller 192 and a fixedly connected part to the actuator 196. The cylindrical cam 116 of the actuator 196 is sized so as to be closely received in a circular hole 118 of the link arm 112, while permitting the link arm 112 to rotate about the cylindrical cam 116. The actuator 196 includes a radial flange 210, which radial flange 210 is disposed between the cover 134 and an upper flat face of the bushing 94. A small post 117 is disposed at the cylindrical cam 116 and engages into the opening of the bushing 94 for proper positioning of the link arm 112 and for preventing the link arm 112 from falling and disengaging from the cylindrical cam 116. The small post 117 is disposed aligned with the rotation axis of the actuator 196 but displaced relative to the central cam axis 68 of the cylindrical cam 116. The outer diameter of the small post 117 is slightly smaller as compared to the diameter of the opening of the bushing 94. The cylindrical cam 116 and the link arm 112 are disposed above the mounting post 194. The central cam axis 68 of the cylindrical cam 116 is disposed displaced relative to the rotation axis of the actuator 196. By this arrangement, a rotation of the actuator 196 around its rotation axis causes the cylindrical cam 116 to eccentrically or laterally move with respect to the rotation axis of the actuator 196. Since the rotation axis of the actuator 196 is fixed relative to the cover 134 and thus also relative to the base member 132, the rotation axis of the actuator 196 is also fixed relative to the mounting post 194 and substantially coincides with the rotation axis for the re-inking roller 192 as defined by an axis of the mounting post 194.

Figure 5:
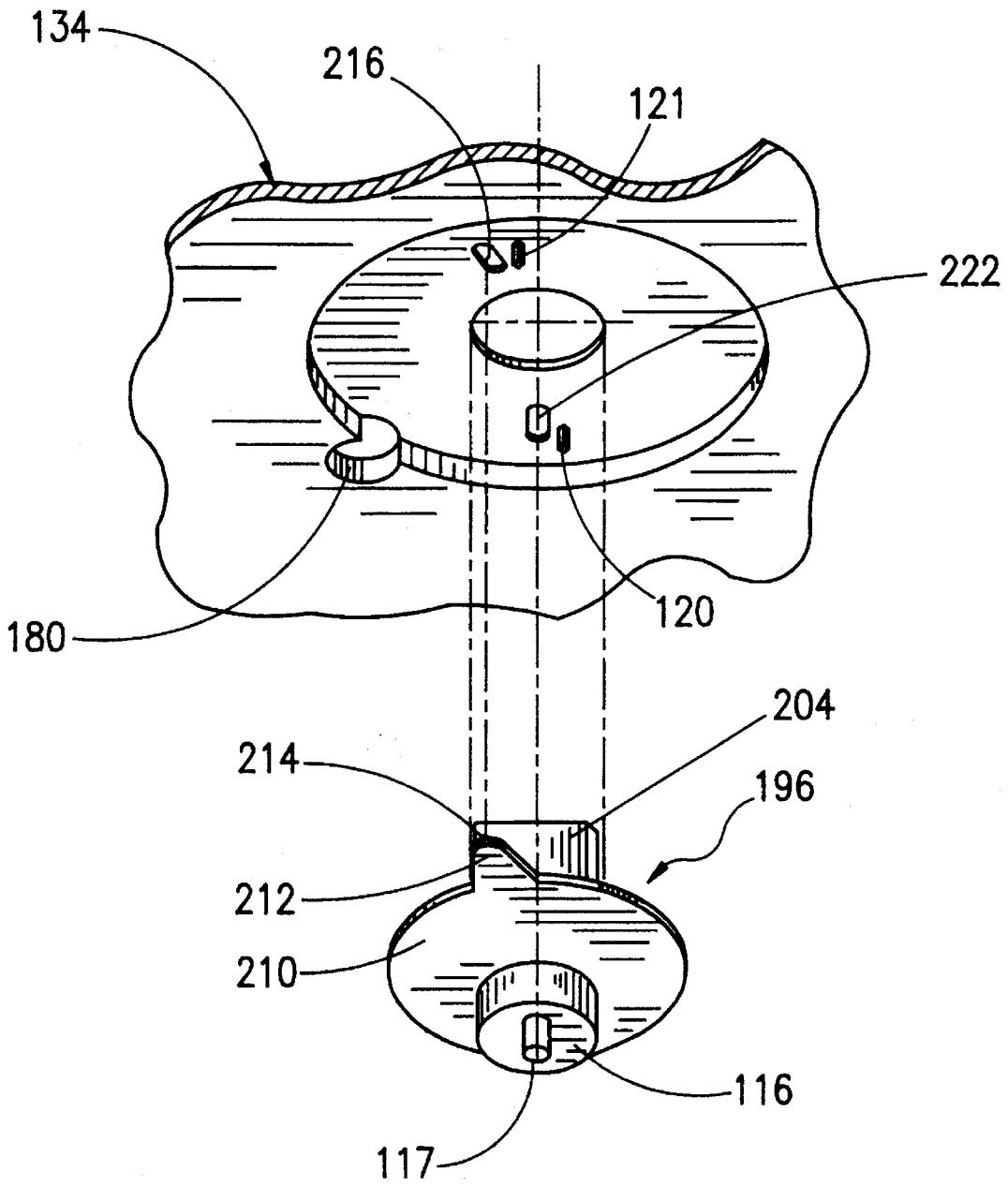
FIG. 5 is a fragmentary exploded perspective view of an actuator and an underside of a cover of a cartridge.

An integral finger tab 204 extending through an actuator opening 206 in the cover 134 is included with the actuator 196. The integral finger tab 204 is adapted to be engaged by the fingers of the user for rotating the integral finger tab 204 about the actuator opening 206 in the cover 134. This actuator opening 206 in the cover is disposed substantially above the mounting post 194. The upper surface of the finger tab 204 includes a printed pointer 208 for the purposes described below. Further, the actuator 196 includes a radial flange 210, which is disposed adjacent the inside surface of the cover 134. The radial flange 210 includes one radial finger 212 having a button 214 on its upper surface facing the cover 134. The inside surface of the cover 134 closely overlies the radial flange 210, as best seen in FIG. 3, and the inside surface of the cover 134 includes two limit stops 120, 121 (FIG. 5) positioned for stopping the radial finger 212 to thereby limit the rotational movement of the actuator 196 between predetermined limits. The cover 134 exhibits in addition two indentations 216, 222 disposed neighboring the limits stops 120, 121, respectively. The button 214 of the finger 212 engages either the indentations 216 or 222 depending on the operative position of the actuator 196.

As illustrated in FIG. 2, a tension spring 156 is positioned in the ribbon supply guide arm 131. The ribbon 158 is disposed along a path which leads from the storage chamber 150, through the ribbon supply passage 152 and past the tension spring 156, which is self-biased into contact with the ribbon. The ribbon 158 then extends across the printing location 140 between the outer ends of the guide arms 131, 138, and it then enters the return guide arm 138 and extends through the ribbon return passage 153. From the return passage 153, the ribbon 158 is guided by the ribbon guide post 168 along the outer side of the ink transfer roller 160. From the ink transfer roller 160, the ribbon extends about the second ribbon guide post 220, then through the nip defined by the drive roller 170 and the idler roller 172, and then back into the storage chamber 150. Also, the rotation of the drive roller 170 acts to tension the ribbon 158 rearwardly along its path of travel between the drive roller 170 and the tension spring 156 such that the ribbon 158 is tightly pressed against the back side of the ink transfer roller 160.

Figure 1:
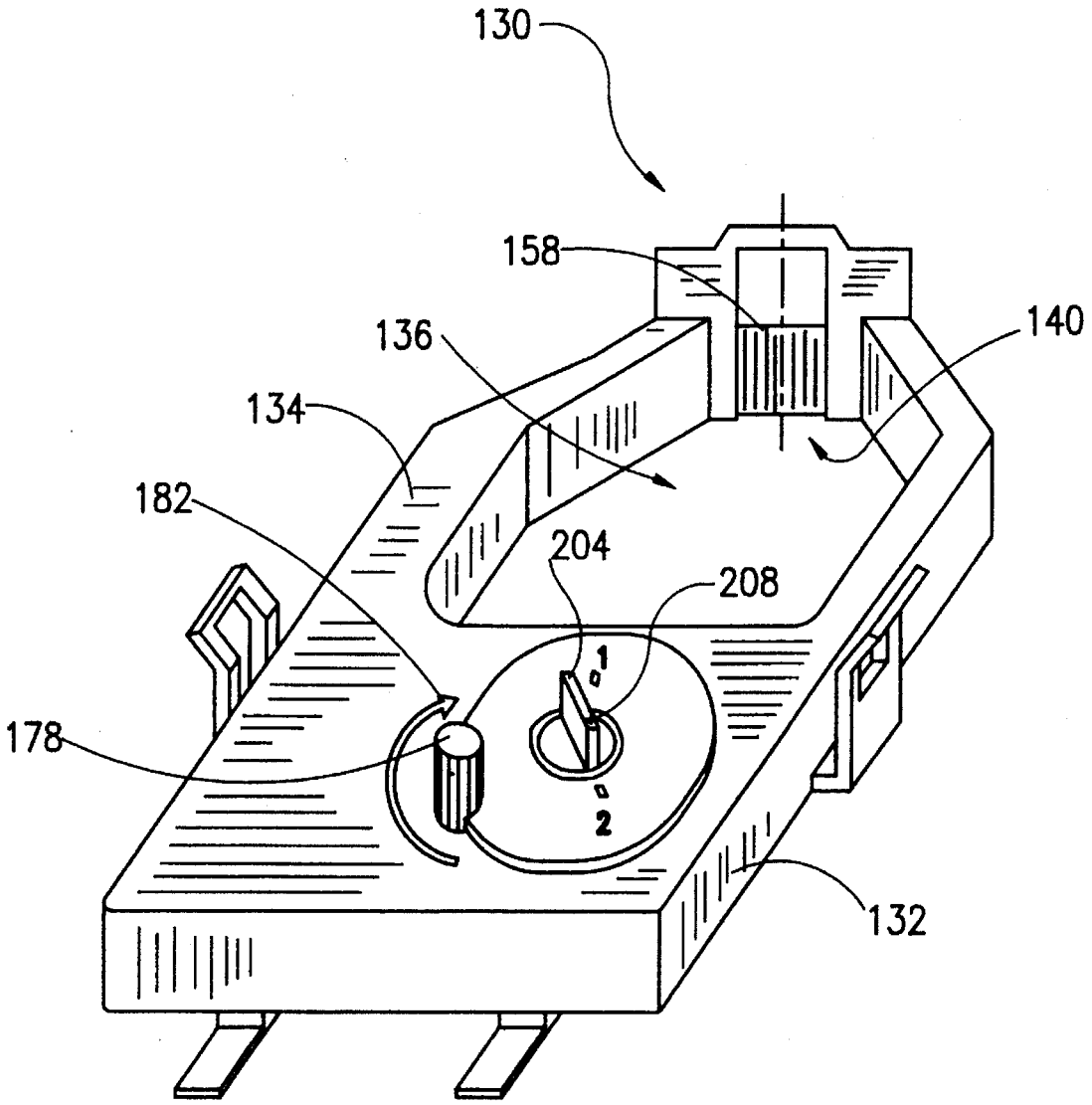
FIG. 1 is a perspective view of a replaceable ribbon cartridge for printers which embodies the invention features.
Figure 6:
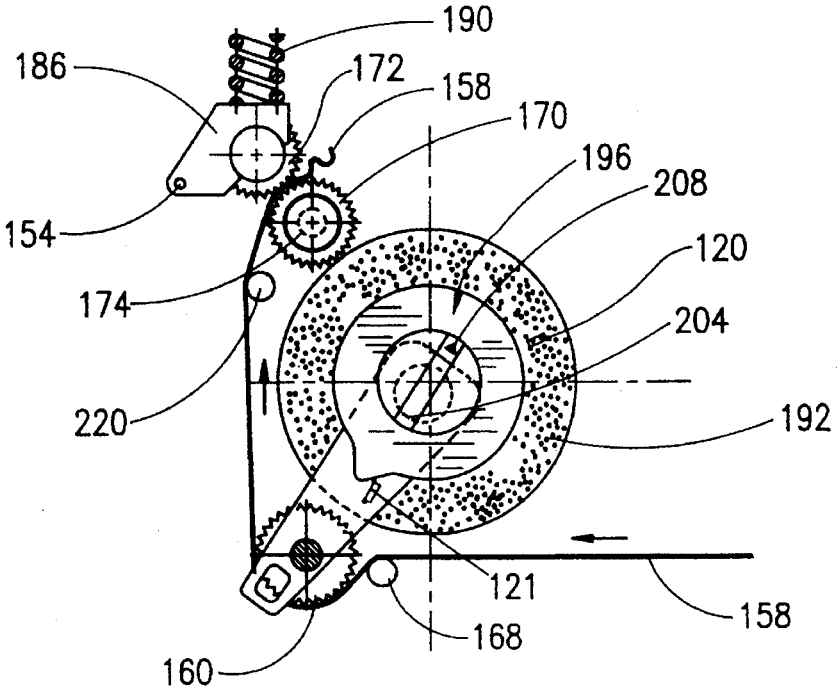
FIG. 6 is a fragmentary plan view of a re-inking roller in a first operative position, as selected by the user.
Figure 7:
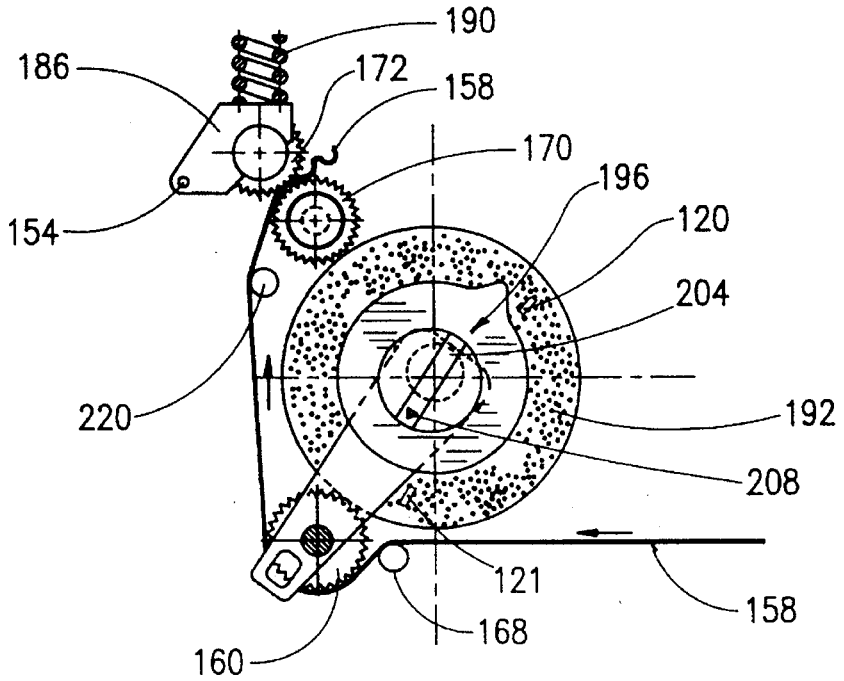
FIG. 7 is a fragmentary plan view of a re-inking roller in a second operative position, as selected by the user.

The ink transfer roller 160 is adapted to be moved by the user to either one of two end positions illustrated in FIGS. 6 and 7. The ink transfer roller 160 and the re-inking roller 192 do not engage in a first operative end position, position 1 of the actuator 196 as illustrated in FIG. 6, and the ink transfer roller 160 and the re-inking roller 192 engage in a second operative end position, position 2 of the actuator as illustrated in FIG. 7. An engagement between the drive roller 170 and the re-inking roller 192 is present at all times. Initially, the actuator 196 is rotated to the position illustrated in FIG. 6 such that the ink transfer roller 160 assumes a neutral or inoperative positional, where the ink transfer roller 160 is separated from the re-inking roller 192. This neutral position 1 occurs when the pointer 208 on the finger tab 204 of the actuator 196 is pointed toward the "1" symbol on the cover 134, as seen in FIG. 1. The neutral position is also defined in that the central cam axis 68 of the cylindrical cam 116 is disposed on the side of the rotation axis of the actuator 196 located close to the pin 114.

The transfer of ink is substantially limited to that which is accomplished by the drive roller 170 in cases where the neutral position is set for the actuator 196. The neutral position may be used during the initial operation of the cartridge at slow printing speeds, and while adequate ink remains in the ribbon 158. In this position, it will also be noted that the finger 212 of the actuator 196 is in engagement with a first limit stop 120, so as to preclude rotation of the actuator beyond the limit stop 120.

The user may rotate the actuator 196 to a second operative position 2, where the pointer 208 points to the "2" symbol on the cover 134, and where the finger 212 engages a second limit stop 120, as seen in FIG. 7, in situations of heavy duty applications, such as the printing of graphics, or when the print quality deteriorates. The position 2 is also defined in that the central cam axis 68 of the cylindrical cam 116 is disposed on the side of the rotation axis of the actuator 196 located remote from the pin 114 and in that the ink transfer roller 160 is thereby moved to a position relatively close to the re-inking roller 192. In the position "2", the finger 212 is in engagement with the second limit stop 120, so as to preclude further rotation of the actuator as seen in FIGS. 2 and 7 beyond the limit stop 120.

The user may alternatively rotate the actuator 196 to any position between the first operative position 1, respectively the first limit stop 121, and the second operative position 2, respectively the second limit stop 120. The tension imparted to the ribbon 158 by the drive means, formed by the drive roller 170 and the idler roller 172, will cause the ribbon 158 to engage more or less tightly the rear surface of the ink transfer roller 160 and thereby to bias the ink transfer roller 160 into a more or less firm contact with the re-inking roller 192. Thus, an adequate delivery of the ink from the re-inking roller 192 to the ribbon 158 through the ink transfer roller 160 is assured.

The placing of the actuator 196 into the position "2" causes the ink transfer roller 160 to firmly engage the re-inking roller 192, thereby deeply engaging and squeezing the re-inking roller 192 and transferring ink fluid to the outer periphery of the re-inking roller 192. If such deep squeezing occurs, this not only influences transfer of ink fluid from the re-inking roller 192 to the ink transfer roller 160, but also the transfer of ink from the re-inking roller 192 to the drive roller 170 because of the presence of fresh ink brought by the engagement with the ink transfer roller 160 into the peripheral surface area of the re-inking roller 192. Then, the squeezing of the ribbon 158 in the nip formed between the drive roller 170 and the idler roller 172 results in a heavy application of the ink from the surface of the drive roller into the fabric of the ribbon. Thus, in this position "2", the two ink transfer points are most active in the ink transfer, namely, the ink transfer roller 160 and the drive roller 170, based on the squeezing of the re-inking roller 192 by the ink transfer roller 160. Thus, the ink transfer rate to the ribbon by the drive roller 170 is typically significantly greater when the ink transfer roller 160 deeply engages the re-inking roller 192.

It will be understood that each of the elements described above, or two or more together, may also find a useful application in other types of cartridges differing from the types described above.

While the invention has been illustrated and described as embodied in the context of a cartridge for printers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A replaceable ribbon cartridge for printers and which has a user-controllable re-inking capability, comprising a casing;

an endless ribbon positioned within said casing so as to be disposed along a path which includes a portion outside of said casing at a printing location;

drive means for advancing said ribbon along said path and comprising a drive roller rotatably mounted in said casing adjacent said path and so as to be in contact with said ribbon;

an ink transfer roller rotatably disposed in said casing adjacent said path and so as to be in contact with said ribbon;

a mounting post attached to the casing;

a porous re-inking roller disposed for rotating concentrically around the mounting post in said casing, and means for rotatably positioning said ink transfer roller in said casing and including means controllable by the user for laterally moving said ink transfer roller to any position between a first operative position, wherein there is no engagement between the ink transfer roller and the re-inking roller, and a second operative position, wherein there is an engagement between the ink transfer roller and the re-inking roller.

2. The ribbon cartridge according to claim 1, wherein the drive roller is disposed for continuously engaging the re-inking roller and for transferring and imposing a rotation of the drive roller to the re-inking roller.

3. The ribbon cartridge according to claim 1, further comprising means for rotatably mounting said ink transfer roller so as to be movable by a predetermined distance toward and away from said re-inking roller, and with said path of said ribbon being positioned so that the ribbon contacts the ink transfer roller on the side thereof opposite said re-inking roller.

4. The ribbon cartridge according to claim 1, wherein said drive means further comprises an idler roller rotatably mounted to said casing at a location on a side of said drive roller opposite to said re-inking roller and with said path of said ribbon passing between said drive roller and said idler roller.

5. The ribbon cartridge according to claim 3, wherein said ink transfer roller and said drive roller each include axially directed spline means on the outer periphery thereof for facilitating a transfer of ink from said re-inking roller to said ribbon.

6. The ribbon cartridge according to claim 1 further comprising a bushing having an opening, where the mounting post is fixedly mounted to said casing, a central opening extending through said re-inking roller coaxially with respect to the peripheral surface thereof, with said mounting post being received in the opening of the bushing centeredly inserted in said central opening of the re-inking roller, and with said opening of the bushing having a diameter substantially similar to that of said mounting post so as to permit rotation of the re-inking roller around the mounting post.

7. A replaceable ribbon cartridge for printers and which has a user-controllable re-inking capability, comprising a casing;

an endless ribbon positioned within said casing so as to be disposed along a path which includes a portion outside of said casing at a printing location;

drive means for advancing said ribbon along said path and comprising a drive roller rotatably mounted in said casing adjacent said path and so as to be in contact with said ribbon;

an ink transfer roller rotatably disposed in said casing adjacent said path and so as to be in contact with said ribbon;

a porous re-inking roller disposed rotatably around a fixed axis in said casing, and means for rotatably positioning said ink transfer roller in said casing and including means controllable by the user for laterally moving said ink transfer roller to any position between a first operative position, wherein there is no engagement between the ink transfer roller and the re-inking roller, and a second operative position, wherein there is an engagement between the ink transfer roller and the re-inking roller;

means for rotatably mounting said ink transfer roller so as to be movable by a predetermined distance toward and away from said re-inking roller, and with said path of said ribbon being positioned so that the ribbon contacts the ink transfer roller on the side thereof opposite said re-inking roller, wherein the ink transfer roller includes a central borehole;

wherein the means for rotatably mounting said ink transfer roller includes an actuator, a link arm, and a pin attached perpendicular to the link arm, wherein the link arm is eccentrically engaged by the actuator, and wherein the pin is inserted into the central borehole of the ink transfer roller.

8. A replaceable ribbon cartridge for printers and which has a user-controllable re-inking capability, comprising a casing;

an endless ribbon positioned within said casing so as to be disposed along a path which includes a portion outside of said casing at a printing location;

drive means for advancing said ribbon along said path and comprising a drive roller rotatably mounted in said casing adjacent said path and so as to be in contact with said ribbon;

an ink transfer roller rotatably disposed in said casing adjacent said path and so as to be in contact with said ribbon;

a porous re-inking roller disposed rotatably around a fixed axis in said casing, and means for rotatably positioning said ink transfer roller in said casing and including means controllable by the user for laterally moving said ink transfer roller to any position between a first operative position, wherein there is no engagement between the ink transfer roller and the re-inking roller, and a second operative position, wherein there is an engagement between the ink transfer roller and the re-inking roller;

means for rotatably mounting said ink transfer roller so as to be movable by a predetermined distance toward and away from said re-inking roller, and with said path of said ribbon being positioned so that the ribbon contacts the ink transfer roller on the side thereof opposite said re-inking roller, wherein the ink transfer roller includes a central borehole;

wherein the means for rotatably mounting said ink transfer roller includes a rotatable actuator having a cylindrical cam having a central cam axis laterally spaced relative to a position of a rotation axis of the rotatable actuator, a flat link arm having a circular hole for bearing the cylindrical cam for the rotatable actuator to eccentrically engage the flat link arm, and a pin attached perpendicular to a flat side of the link arm, and wherein the pin is inserted into the central borehole of the ink transfer roller.

9. The ribbon cartridge according to claim 8, further comprising means for defining an angular position of the flat link arm relative to the central cam axis of the cylindrical cam.

10. The ribbon cartridge according to claim 9, wherein the flat link arm is provided with an elongated slot, and wherein a cover of the casing is provided with a guide projection engaging the elongated slot for substantially maintaining an angular position of the link arm relative to the central cam axis of the cylindrical cam.

11. A replaceable ribbon cartridge for printers and which has a user-controllable re-inking capability, comprising a casing;

an endless ribbon positioned within said casing so as to be disposed along a path which includes a portion outside of said casing at a printing location;

drive means for advancing said ribbon along said path and comprising a drive roller rotatably mounted in said casing adjacent said path and so as to be in contact with said ribbon;

an ink transfer roller rotatably disposed in said casing adjacent said path and so as to be in contact with said ribbon;

a porous re-inking roller disposed rotatably around a fixed axis in said casing, and means for rotatably positioning said ink transfer roller in said casing and including means controllable by the user for laterally moving said ink transfer roller to any position between a first operative position, wherein there is no engagement between the ink transfer roller and the re-inking roller, and a second operative position, wherein there is an engagement between the ink transfer roller and the re-inking roller;

a means for rotatably mounting said re-inking roller comprises a bushing having an opening and a mounting post, where the mounting post is fixedly mounted to said casing, a central opening extending through said re-inking roller coaxially with respect to the peripheral surface thereof, with said mounting post being received in the opening of the bushing centeredly inserted in said central opening of the re-inking roller, and with said opening of the bushing having a diameter substantially similar to that of said mounting post so as to permit rotation of the re-inking roller around the mounting post, wherein said means controllable by the user for laterally moving said ink transfer roller comprises a link arm defining the operative position of the ink transfer roller and having a circular hole disposed on a first end and a longitudinal slot disposed on a second end;

a guide projection disposed at the cover and engaging the longitudinal slot disposed on the second end of the link arm;

an actuator having a rotation axis and including a cylindrical cam sized so as to be closely received in said circular hole of said link arm, with said circular hole defining an axis of the cylindrical cam, and the axis of the cylindrical cam being laterally offset from said rotation axis of the actuator, and with said circular hole receiving said cylindrical cam therein such that a rotation of said actuator causes said ink transfer roller to laterally move relative to said rotation axis of the actuator.

12. The ribbon cartridge according to claim 11, wherein said actuator further comprises an integral tab adapted to be engaged by fingers of the user for rotating the actuator about the rotation axis of the actuator, and so as to move said ink transfer roller between said first and second operative positions.

13. The ribbon cartridge according to claim 12, wherein said actuator further comprises a radial flange, wherein said casing includes a cover closely overlying said flange.

14. The ribbon cartridge according to claim 13, wherein said cover has an actuator opening therethrough, and wherein said integral tab extends through said actuator opening so as to be readily gripped by the fingers of the user.

15. The ribbon cartridge according to claim 13, wherein said flange of said actuator includes a radial finger at the periphery thereof, wherein two limit stops are disposed at said cover, wherein the limit stops are adapted to limit the rotational movement of said actuator between predetermined limits defined by the location of said limit stops, and wherein two indentations are disposed in each case neighboring the limits stops at said cover, wherein each indentation is adapted to be engaged by a button disposed on the radial finger depending on the operative position of the actuator.

16. The ribbon cartridge according to claim 13, wherein said flange of said actuator includes a radial finger at the periphery thereof, wherein two limit stops are disposed at said cover, and wherein the limit stops are adapted to limit the rotational movement of said actuator between predetermined limits defined by the location of said radial finger on the actuator, and wherein two indentations are disposed in each case neighboring the limits stops at said cover, wherein each indentation is adapted to be engaged by a button disposed on the radial finger depending on the operative position of the actuator.

17. A replaceable ribbon cartridge for printers and which has a user controllable re-inking capability, comprising a casing;

an endless ribbon positioned within said casing so as to be disposed along a path which includes a portion outside of said casing at a printing location;

drive means for advancing said ribbon along said path and comprising a drive roller rotatably mounted in said casing adjacent said path and so as to be in contact with said ribbon;

round means for mounting disposed at the casing;

an ink transfer roller for rotating concentrically around the round means for mounting and positioned in said casing adjacent said path and so as to be in contact with said ribbon;

a porous re-inking roller rotatably disposed in said casing;

an actuator, a link arm, a pin attached perpendicular to the link arm, wherein the link arm is eccentrically engaged by the actuator, and wherein the pin is inserted into a central borehole of the ink transfer roller, and wherein rotation of the actuator causes moving of the ink transfer roller between a first operative position, wherein there is no engagement between the ink transfer roller and the re-inking roller, and a second operative position, wherein an engagement between the ink transfer roller and the re-inking roller is present, and with said path of said ribbon being positioned so that the ribbon contacts the ink transfer roller on the side thereof opposite said re-inking roller.

18. A replaceable ribbon cartridge for printers and which has a user controllable re-inking capability, comprising a casing;

an endless ribbon positioned within said casing so as to be disposed along a path which includes a portion outside of said casing at a printing location;

drive means for advancing said ribbon along said path and comprising a drive roller rotatably mounted in said casing adjacent said path and so as to be in contact with said ribbon;

an ink transfer roller disposed in said casing adjacent said path and so as to be in contact with said ribbon;

round mounting means formed at the casing;

a porous re-inking roller for rotating concentrically around the round mounting means and disposed in said casing; and means for rotatably supporting said ink transfer roller in said casing and including means controllable by the user for moving said ink transfer roller between a first operative position relating to a minor transfer of ink from the re-inking roller to the ink transfer roller, and a second operative position relating to a major transfer of ink from the re-inking roller to the ink transfer roller.

* * * * *